US005085917A

United States Patent [19]

Hodnett, III

[11] Patent Number: 5,085,917

[45] Date of Patent: Feb. 4, 1992

[54] FABRIC HAVING RAVEL RESISTANT SELVAGES AND METHOD FOR IMPARTING THE SAME

[75] Inventor: William P. Hodnett, III, Martinsville, Va.

[73] Assignee: Thor Radiation Research, Inc., Martinsville, Va.

[21] Appl. No.: 507,680

[22] Filed: Apr. 10, 1990

[51] Int. Cl.[5] ..... B32B 3/08; B05D 3/06; B05D 3/12; D03D 47/40; D03D 49/70

[52] U.S. Cl. ..... 428/173; 26/10.4; 139/302; 427/54.1; 427/285; 427/358; 427/369

[58] Field of Search ..... 26/10.4; 139/302; 427/54.1, 285, 358, 369; 428/193

[56] References Cited

U.S. PATENT DOCUMENTS

| | | | |
|---|---|---|---|
| 3,515,623 | 6/1970 | Bates | 428/193 |
| 3,620,803 | 11/1971 | Lineberger | 428/193 |
| 4,109,042 | 8/1978 | Estes et al. | 428/193 |
| 4,230,766 | 10/1980 | Gaussens et al. . | |
| 4,287,227 | 9/1981 | Kamada et al. . | |
| 4,324,827 | 4/1982 | Obayashi et al. | 428/193 |
| 4,339,474 | 7/1982 | Kishida et al. . | |
| 4,384,021 | 5/1983 | Aoyama | 428/193 |
| 4,407,848 | 10/1983 | Yamaguchi et al. | 427/285 |
| 4,428,995 | 1/1984 | Yokono et al. | 428/193 |
| 4,490,433 | 12/1984 | Shigeru et al. . | |
| 4,758,448 | 7/1988 | Sandvig et al. . | |
| 4,767,643 | 8/1988 | Westervelt et al. . | |
| 4,791,004 | 12/1988 | Suzuki et al. . | |
| 4,888,229 | 12/1989 | Paley et al. | 428/193 |
| 4,894,276 | 1/1990 | Bryant | 428/193 |

FOREIGN PATENT DOCUMENTS

| | | | |
|---|---|---|---|
| 3608787 | 10/1987 | Fed. Rep. of Germany | 428/193 |
| 2434235 | 3/1980 | France . | |
| 50-119869 | 9/1975 | Japan . | |
| 60-215030 | 10/1985 | Japan . | |

*Primary Examiner*—James C. Cannon

*Attorney, Agent, or Firm*—Bell, Seltzer, Park & Gibson

[57] ABSTRACT

This invention relates to a fabric having a radiation cured crosslinked coating composition applied to the selvages of the fabric to provide ravel resistance thereto. The coating composition is a copolymer of an elastomeric-forming low viscosity monofunctional acrylate monomer and a reactive polyfunctional acrylate monomer. A method of forming a ravel resistant selvage in a fabric is also provided.

26 Claims, 1 Drawing Sheet

FABRIC HAVING RAVEL RESISTANT SELVAGES AND METHOD FOR IMPARTING THE SAME

FIELD AND BACKGROUND OF THE INVENTION

The present invention relates to the production of a fabric having selvages which have been treated to impart ravel resistance thereto.

In the manufacturing of a fabric, it is important that the selvages which extend along longitudinal side edges of the fabric be formed in such a way that they remain intact and do not ravel. When weaving fabrics with traditional shuttle-type looms, this was not a particular problem, since a finished ravel-resistant woven selvage was inherently formed by the inserted weft yarn when the shuttle reversed direction at each side edge of the fabric. However, the newer types of high speed shuttleless looms, such as air jet and water jet looms, form a ragged or fringed selvage which typically must be trimmed from the fabric during the manufacturing operation. This trimmed edge can be subject to raveling during subsequent manufacturing operations and during use.

In some types of fabrics, such as bed sheets and towels for example, the trimmed selvages can be turned under and a hem can be formed along the longitudinal side edges to thereby seal the trimmed edges and prevent fraying. In fabrics where thermoplastic fibers are used, it is also possible that the trimmed edges can be sealed and fused, as described for example in U.S. Pat. No. 4,496,407. In other types of fabrics, if the selvage area is woven tightly enough, the trimmed edge can be left as-is without presenting a significant fraying problem. However, there are many instances where the above techniques cannot be used.

For example, in loosely woven fabrics, the selvages have an increased tendency to ravel. Depending upon the use which is to be made of the fabric, it may not be possible to form a hem along the selvage areas. Fiberglass reinforced composite products, for instance, use a loosely woven reinforcing fabric formed from fiberglass yarns or rovings. The edges of this fabric are subject to raveling during shipment and handling. Woven fiberglass fabrics are also used as reinforcement in printed circuit boards, and these fabrics are typically subjected to a number of handling operations, such as cleaning and/or scouring baths, where raveling is a problem.

With the foregoing in mind, it is an important object of the present invention to provide an improved method for imparting ravel resistance to the selvages of a fabric.

It is a further object of this invention to provide a fabric with selvages which have been treated to impart ravel resistance.

It is still another object of this invention to provide a method of the type described which can form ravel-resistant selvages at speeds which are practical for commercial production.

SUMMARY OF THE INVENTION

These and other objects are achieved in accordance with the present invention with the use of a particular class of radiation curable polymer composition which is applied to the selvage areas of the fabric in an uncured condition and is thereafter rapidly cured and hardened by exposing the composition to radiation. The cured and hardened composition bonds the yarns together in the selvage area, and the fringed selvage portion can then be trimmed from the fabric, leaving a clean-cut ravel-resistant edge on the fabric.

The present invention provides a fabric which includes a fabric base formed of interengaged strands and having a selvage along at least one longitudinal side edge thereof. An uncured radiation curable coating composition is applied to the selvage and cured to provide ravel resistance thereto. The radiation curable coating composition comprises a copolymer of an elastomeric-forming low viscosity monofunctional acrylate monomer and a reactive polyfunctional acrylate monomer.

More specifically the radiation curable coating composition comprises a copolymer of an elastomeric-forming low viscosity monofunctional acrylate monomer selected from the group consisting of tetrahydrofurfuryl acrylate, cyclohexyl acrylate, isooctyl acrylate, isodecyl acrylate, n-lauryl acrylate, 2-phenoxyethyl acrylate and 2-ethoxyethoxyethyl acrylate, and a reactive polyfunctional acrylate monomer selected from the group consisting of triacrylate, tetraacrylate, pentaacrylate and hexaacrylate monomers.

Additionally, the present invention provides a method of forming a ravel resistant selvage in a fabric. The method includes the steps of advancing a fabric formed of interengaged strands and having a selvage area along at least one longitudinal side edge thereof along a predetermined path of travel to and through a coating application station, depositing onto the selvage area of the fabric at the coating application station, an uncured radiation curable coating composition comprising an elastomeric-forming low viscosity monofunctional acrylate monomer and a reactive polyfunctional acrylate monomer, advancing the coated fabric from the coating application station to and through a curing station and subjecting the coated selvage area of the fabric to radiation while at the curing station to polymerize and cure the radiation curable coating composition into a hardened cured crosslinked polymer composition which will bond together the strands in the selvage area to provide ravel resistance, and advancing the thus cured, coated fabric from the curing station to a trimming station and trimming the fabric in the selvage area containing the cured and hardened composition.

BRIEF DESCRIPTION OF THE DRAWINGS

Some of the features and advantages have been stated, others will become apparent from the detailed description which follows, and from the accompanying drawings, in which.

DETAILED DESCRIPTION OF THE PREFERRED EMBODIMENT OF THE INVENTION

Ravel resistance can be provided to the selvages of fabrics of various constructions such as woven, nonwoven, knitted constructions. The term "fabric" includes fabrics made of fiberglass, natural fibers such as cotton, wool and flax, and synthetic fibers such as polyester, polyolefins, polyamides, polyacrylonitriles, etc. The present invention is particularly applicable to providing a ravel-resistant selvage for a woven fabric formed on a shuttleless loom from interwoven yarns of fiberglass. These woven fiberglass fabrics are typically used as reinforcement in printed circuit boards and often are subjected to cleaning and/or scouring baths where raveling can be a problem.

Figure 2:
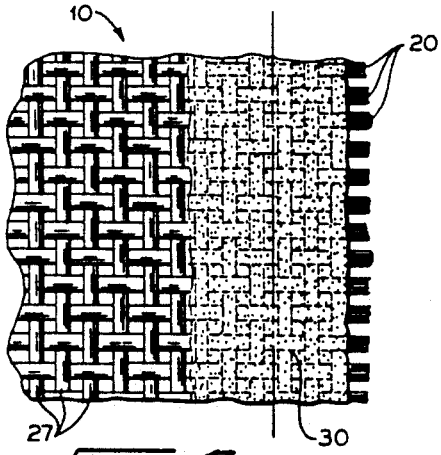
FIG. 2 is a enlarged partial plan view showing a woven fabric with selvages which is coated with a radiation cured coating composition.
Figure 3:
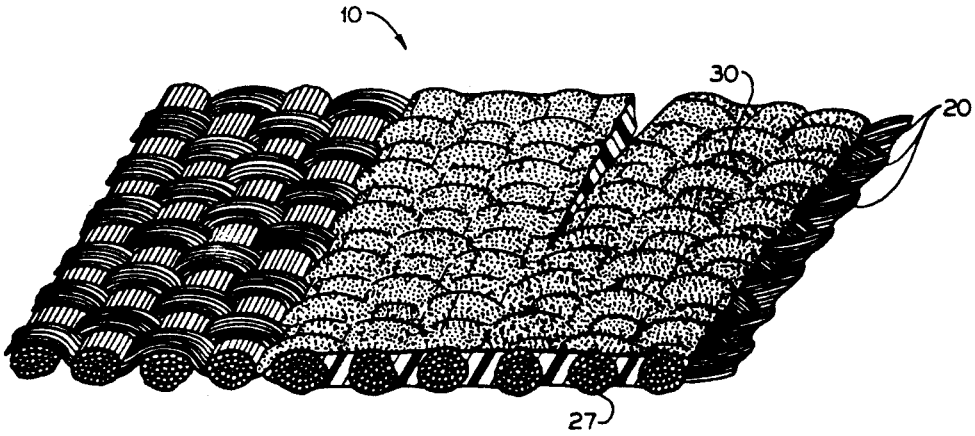
FIG. 3 is an enlarged perspective view showing a woven fabric with selvages and the radiation cured coating composition thereon, and further showing a selvage in a partially trimmed state.

The figures show a fabric 10 having a selvage 20 along a longitudinal side edge thereof. Referring to FIGS. 2 and 3, a fabric 10 formed of interwoven fiberglass yarns 27 is shown. A radiation curable uncrosslinked coating composition is applied to the area of the selvage. This uncured, uncrosslinked coating composition is cured into a crosslinked, hardened polymer composition 30 which will bond together the strands in the selvage area to provide ravel resistance. Additionally, the cured composition 30 provides chemical resistance to solvents, such as the solvents in finishing baths used in later processing steps.

The coating composition comprises a copolymer of an elastomeric-forming low viscosity monofunctional acrylate monomer and a reactive polyfunctional acrylate monomer. The copolymer may include 10–90% by weight of the monofunctional acrylate monomer, and 90–10% by weight of the polyfunctional acrylate monomer. A preferred copolymer composition contains 25–75% by weight of the monofunctional acrylate monomer and 75–25% by weight of the polyfunctional acrylate monomer, and an especially preferred copolymer composition contains 40–60% by weight of the monofunctional acrylate and 60–40% of the polyfunctional acrylate. This composition is unusual in that it is a two monomer system as compared to the typical radiation cured compositions wherein a large portion of the formulation is a viscous oligomer or resin.

The monomers used in the composition are selected for the unique characteristics which they contribute to the composition. The monofunctional acrylate monomer has a low viscosity which enables the coating composition to readily penetrate into the fabric. The monofunctional acrylate monomer typically has a viscosity less than about 50 centipoise and preferably less than about 20 centipoise. The viscosity of the polyfunctional acrylate monomer is greater than the monofunctional acrylate monomer, but not so great that it inhibits the ability of the composition to readily penetrate into the fabric. Typically, the polyfunctional acrylate has a viscosity greater than about 500 centipoise and up to about 20,000 cps.

The low viscosity monofunctional acrylate monomer used in the copolymer composition is an elastomeric-forming monomer and provides elasticity to the coating composition. By the term "elastomeric-forming monomer", it is meant that the structure of the monomer contributes elastomeric properties to a polymer or copolymer formed therewith. This property can be determined by bulk curing the monomer and observing whether the resulting homopolymer has elastomeric properties.

The polyfunctional acrylate monomer should be a highly reactive monomer to provide a high cure rate in air to the copolymer. This makes it possible to process the fabric at a high rate of production.

Exemplary elastomeric low viscosity monofunctional acrylate monomers suitable for use in the composition include tetrahydrofurfuryl acrylate, cyclohexyl acrylate, isooctyl acrylate, isodecyl acrylate, n-lauryl acrylate, 2-phenoxyethyl acrylate and 2-ethoxyethoxyethyl acrylate. Examples of commercially available monomers include Sartomer-285, Sartomer-220, and Sartomer-339 each available from Arco Specialty Chemicals of West Chester, Pa.

Reactive polyfunctional acrylate monomers suitable for use in the present invention include triacrylate, tetraacrylate, pentaacrylate and hexaacrylate monomers. Specific monomers include pentaerythritol triacrylate, glyceryl propoxylate triacrylate, trimethylolpropane triacrylate, trimethylolpropane propoxylate triacrylate, ethoxylated trimethylolpropane triacrylate, pentaerythritol tetraacrylate, dimethylolpropane tetraacrylate, dipentaerythritol pentaacrylate, and dipentaerythritol monohydroxypentaacrylate. Preferably pentaacrylate monomers of dipentaerythritol are used. Examples of suitable commercially available polyfunctional acrylate monomers include Sartomer-399 and Sartomer-444 both also available from Arco Specialty Chemicals of West Chester, Pa.

No further monomers, diluents or solvents are required in the coating composition. This avoidance of using solvents is a particular advantage inasmuch as the requirement of expensive solvent handling and solvent recovery equipment is avoided. The coating composition may also include small percentages of a very low viscosity di-functional polyurethane (e.g. Sartomer-9650 available from Arco Specialty Chemicals). About 10–20% by weight of the di-functional polyurethane may be added to further increase the flexibility of the cured coating composition. The coating composition additionally may, include fillers and reinforcing agents, dyestuffs, pigments, heat and light stabilizers, photoinitiators, surfactants, flattening agents and the like.

The copolymer may be cured by any source of ionizing radiation capable of producing free radicals, including gamma radiation, infrared, microwave, but more typically by electron beam or ultraviolet radiation. Especially suitable ultraviolet radiation is in the 200–400 mm wavelength. When polymerization is by ultraviolet radiation, the curable compositions typically include up to 5% by weight of a photoinitiator compound for inducing curing in accordance with known practices for UV curable compositions. An exemplary photoinitiator is 1-hydroxycyclohexyl phenyl ketone.

Figure 1:
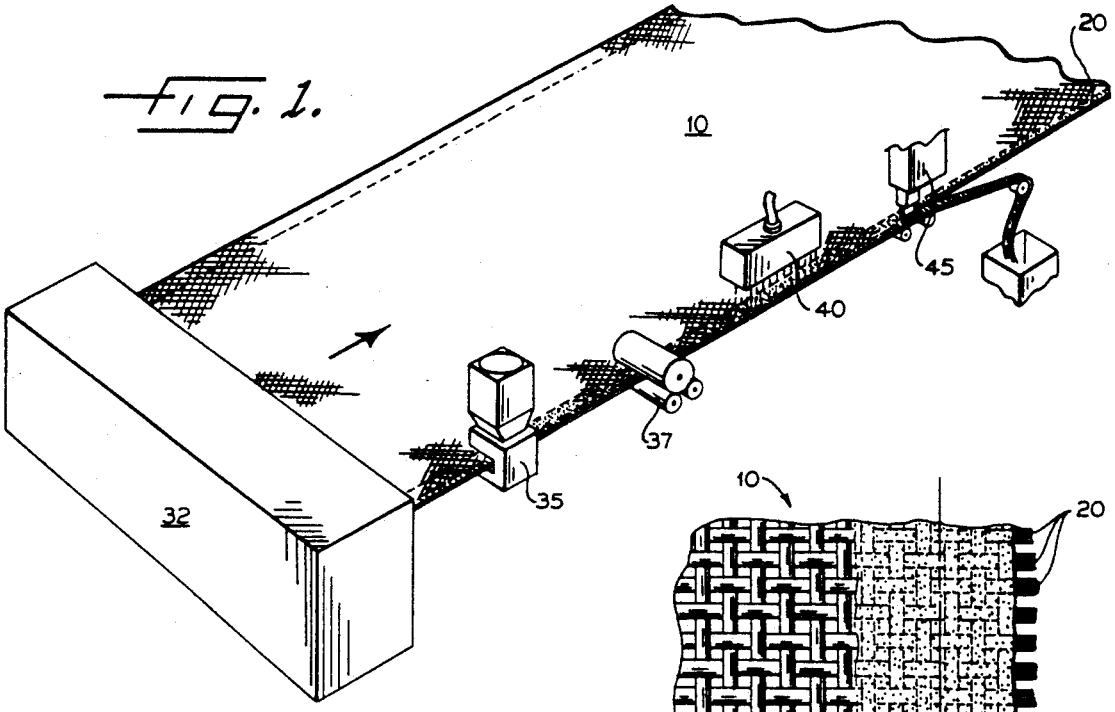
FIG. 1 is a perspective view illustrating the method of the present invention.

Referring to FIG. 1, in operation the fabric 10 is formed and exits a loom 32 or the like and is advanced along a predetermined path of travel to and through a coating application station 35. The coating composition 30 is applied in a conventional manner such as by roll coating, gravure coating, dribbling, dipping, spraying, etc. An approximately ¼ to ½ inch wide amount of the coating composition is applied to the fabric 10. Application and penetration into the fabric is facilitated by the low viscosity provided by the monofunctional acrylate monomer. Additionally, the fabric 10 may be directed into and through a penetrating station 37 wherein pressure is applied by rolls to the coated selvage area to further facilitate penetration of the uncured radiation curable composition into the fabric 10. Although the application station 35 and the penetrating station 37 are shown as two separate stations, it will be apparent that these stations can be combined into one station.

The coated fabric 10 is then advanced to and through a curing station 40 at a rate of about 150 to 400 feet per minute. At the curing station 40, the fabric is subjected to radiation to polymerize and cure the radiation curable uncrosslinked coating composition 30 into a hardened cured crosslinked polymer composition which will bind together the strands in the selvage area to provide ravel resistance. The high cure rate of the reactive polyfunctional acrylate monomer allows the process to operate economically at a high rate of production. The fabric 10 is then advanced from the curing station to a trimming station 45 and trimmed in the fringed selvage area containing the cured hardened composition to leave a clean-cut ravel-resistant edge on the fabric 10. Conventional trimming apparatus, well known in the art, may be employed.

The present invention and its advantages over the prior art will be more fully understood and appreciated from the illustrative example which follows. It is to be understood that the example is for the purpose of illustration and is not intended as being limiting upon the scope of the invention. A person skilled in the applicable arts will appreciate from this example that this invention can be embodied in many different forms other than as is specifically disclosed.

EXAMPLE

A coating composition was prepared consisting of 47.5 parts by weight dipentaerythritol monohydroxy pentaacrylate monomer (Sartomer-399), 47.5 parts by weight tetrahydrofurfuryl acrylate (Sartomer-285), and 5 parts by weight photoinitiator (1-hydroxycyclohexyl phenyl ketone). This composition was coated onto the surface of a woven fiberglass fabric by dribbling it onto an applicator roll with a backup roll, and allowing it to penetrate into the fiber bundles of the fabric. Penetration is facilitated by passing it through rolls to apply pressure to the fabric. The fabric was directed under a 3,000 watt Fusion Systems Corporation UV curing lamp at 405 feet per minute to cure the coating. The fabric was then trimmed in the selvage area. The selvages were ravel resistant and exhibited chemical resistance to solvents.

In the drawings and specification there have been disclosed typical preferred embodiments of the invention and, although specific terms are employed, they are used in a generic and descriptive sense only and not for purposes of limitation, the scope of the invention being set forth in the following claims.

That which we claim is:

1. A fabric characterized by having ravel resistant selvages, said fabric comprising a fabric base formed of interengaged strands and having a selvage along at least one longitudinal side edge thereof, and a radiation cured crosslinked coating composition applied to said selvage to provide ravel resistance thereto, said radiation cured crosslinked coating composition comprising a copolymer of an elastomeric-forming low viscosity monofunctional acrylate monomer and a reactive polyfunctional acrylate monomer.

2. A fabric according to claim 1 wherein said reactive polyfunctional acrylate monomer is selected form the group consisting of triacrylate, tetraacrylate, pentaacrylate and hexaacrylate monomers.

3. A fabric according to claim 1 wherein said elastomeric-forming low viscosity monofunctional acrylate monomer is selected from the group consisting of tetrahydrofurfuryl acrylate, cyclohexyl acrylate, isooctyl acrylate, isodecyl acrylate, n-lauryl acrylate, 2-phenoxyethyl acrylate and 2-ethoxyethoxyethyl acrylate.

4. A fabric according to claim 1 wherein said radiation cured crosslinked coating composition includes a photoinitiator for inducing curing by UV radiation.

5. A fabric according to claim 1 wherein said copolymer is derived from at least 10 percent by weight of said polyfunctional acrylate monomer.

6. A fabric according to claim 1, wherein said monofunctional monomer is tetrahydrofurfuryl acrylate and said polyfunctional acrylate monomer comprises a pentaacrylate monomer of dipentaerythritol.

7. A fabric according to claim 1, wherein said monofunctional monomer is cyclohexyl acrylate and said polyfunctional acrylate monomer comprises a pentaacrylate monomer of dipentaerythritol.

8. A fabric according to claim 1, wherein said monofunctional monomer is 2-phenoxyethyl acrylate and said polyfunctional acrylate monomer comprises a pentaacrylate monomer of dipentaerythritol.

9. A fabric according to claim 1 wherein said copolymer is derived from substantially equal proportions of said monofunctional acrylate monomer and said polyfunctional acrylate monomer.

10. A fabric according to claim 1 wherein said copolymer is a copolymer of 10–90% by weight of a pentaacrylate monomer and 90–10% by weight of a monomer selected from the group consisting of tetrahydrofurfuryl acrylate, cyclohexyl acrylate, isooctyl acrylate, isodecyl acrylate, n-lauryl acrylate, 2-phenoxyethyl acrylate and 2-ethoxyethoxyethyl acrylate.

11. A fabric according to claim 1 wherein said coating composition includes from about 10–20% by weight of a di-functional polyurethane.

12. A woven fabric characterized by having ravel resistant selvages, said woven fabric comprising a fabric base formed of interwoven fiberglass yarns and having a selvage along at least one longitudinal side edge thereof, and a radiation cured crosslinked coating composition applied to said selvages to provide ravel resistance thereto, said radiation cured crosslinked coating composition comprising a copolymer of:

(a) 10–90% by weight of an elastomeric-forming low viscosity monofunctional monomer having a viscosity less than about 50 centipoise;

(b) 10–90% by weight of a reactive polyfunctional acrylate monomer; and (c) 0–5% by weight of a photoinitiator for inducing radiation curing.

13. A woven fabric according to claim 12 wherein said reactive polyfunctional acrylate monomer is selected from the group consisting of triacrylate, tetraacrylate, pentaacrylate and hexaacrylate monomers.

14. A woven fabric according to claim 12 wherein said reactive low viscosity monofunctional acrylate monomer is selected from the group consisting of tetrahydrofurfuryl acrylate, cyclohexyl acrylate, isodecyl acrylate, n-lauryl acrylate, 2-phenoxyethyl acrylate, and 2-ethoxyethoxyethyl acrylate.

15. A fabric according to claim 12, wherein said monofunctional monomer is tetrahydrofurfuryl acrylate and said polyfunctional acrylate monomer comprises a pentaacrylate monomer of dipentaerythritol.

16. A fabric according to claim 12, wherein said monofunctional monomer is cyclohexyl acrylate and said polyfunctional acrylate monomer comprises a pentaacrylate monomer of dipentaerythritol.

17. A fabric according to claim 12, wherein said monofunctional monomer is 2-phenoxyethyl acrylate and said polyfunctional acrylate monomer comprises a pentaacrylate monomer of dipentaerythritol.

18. A fabric according to claim 12 wherein said coating composition includes from about 10 to 20% by weight of a di-functional polyurethane.

19. A method of forming a ravel resistant selvage in a fabric comprising the steps:

(a) advancing a fabric formed of interengaged strands and having a selvage area along at least one longitudinal side edge thereof along a predetermined path of travel to and through a coating application station;

(b) depositing onto the selvage area of the fabric at the coating application station, an uncured radiation curable uncrosslinked coating composition comprising an elastomeric-forming low viscosity monofunctional acrylate monomer and a reactive polyfunctional acrylate monomer;

(c) advancing the coated fabric from the coating application station to and through a curing station and subjecting the coated selvage area of the fabric to radiation while at the curing station to polymerize and cure the radiation curable coating composition into a hardened cured crosslinked polymer composition which will bond together the strands in the selvage area to provide ravel resistance; and (d) advancing the thus cured fabric from the curing station to a trimming station and trimming the fabric in the selvage area containing the cured and hardened composition.

20. A method according to claim 19 including the further step of directing the fabric as it advances from the coating application station to the curing station into and through a penetrating station and applying pressure to the coated selvage area to facilitate penetration of the uncured radiation curable composition into the fabric.

21. A method according to claim 19 wherein the reactive polyfunctional acrylate monomer is selected from the group consisting of triacrylate, tetraacrylate, pentaacrylate and hexaacrylate monomers.

22. A method according to claim 19 wherein the reactive low viscosity monofunctional acrylate monomer is selected from the group consisting of tetrahydrofurfuryl acrylate, cyclohexyl acrylate, isooctyl acrylate, isodecyl acrylate, n-lauryl acrylate, 2-phenoxyethyl acrylate, and 2-ethoxyethoxyethyl acrylate.

23. A method according to claim 19 wherein the radiation is provided by a UV light source.

24. A method of forming a ravel resistant selvage in a fiberglass fabric comprising the steps of:

(a) advancing a fabric formed of interwoven yarns of fiberglass and having a selvage area along at least one longitudinal side edge thereof along a predetermined path of travel to and through a coating application station;

(b) depositing onto the selvage area of the fabric at the coating application station, an uncured radiation curable uncrosslinked coating composition comprising:

(i) 10–90% by weight of an elastomeric-forming low viscosity monofunctional monomer having a viscosity less than about 50 centipoise;

(ii) 10–90% by weight of a reactive polyfunctional acrylate monomer; and (iii) 0–5% by weight of a photoinitiator for inducing radiation curing;

(c) directing the coated fabric from the coating application station to and through a penetration station and applying pressure to the coated selvage area to facilitate penetration of the uncured radiation curable uncrosslinked composition into the fabric;

(d) advancing the coated fabric from the penetration application station to and through a curing station and subjecting the coated selvage area of the fabric to UV radiation in the 200–400 mm wavelength while at the curing station to polymerize and cure the radiation curable coating composition into a hardened cured crosslinked polymer composition which will bond together the strands in the selvage area to provide ravel resistance; and (e) advancing the thus cured fabric from the curing station to a trimming station and trimming the fabric in the selvage area containing the cured and hardened composition.

25. A method according to claim 24 wherein the reactive polyfunctional acrylate monomer is selected from the group consisting of triacrylate, tetraacrylate, pentaacrylate and hexaacrylate monomers.

26. A method according to claim 24 wherein the reactive low viscosity monofunctional acrylate monomer is selected from the group consisting of tetrahydrofurfuryl acrylate, cyclohexyl acrylate, isooctyl acrylate, isodecyl acrylate, n-lauryl acrylate, 2-phenoxyethyl acrylate, and 2-ethoxyethoxyethyl acrylate.

* * * * *